US007390266B2

(12) United States Patent
Gwon

(10) Patent No.: US 7,390,266 B2
(45) Date of Patent: Jun. 24, 2008

(54) GOLF CLUB

(76) Inventor: Young Doo Gwon, 106-2103, Jeonghwa-woobang-palace, 72, Sang-dong, Sooseong-gu, Daegu (KR) 706-775

( * ) Notice: Subject to any disclaimer, the term of this patent is extended or adjusted under 35 U.S.C. 154(b) by 0 days.

(21) Appl. No.: 11/454,718

(22) Filed: Jun. 19, 2006

(65) Prior Publication Data

US 2007/0293333 A1 Dec. 20, 2007

(51) Int. Cl.
*A63B 69/36* (2006.01)

(52) U.S. Cl. ..... 473/228; 473/327

(58) Field of Classification Search ..... 473/228, 473/324, 327; D21/733, 739
See application file for complete search history.

(56) References Cited

U.S. PATENT DOCUMENTS 1,690,388 A * 11/1928 Waldron ..... 473/327
D185,717 S * 7/1959 Newton ..... D21/733
D192,515 S * 4/1962 Henrich ..... D21/733
3,719,363 A * 3/1973 Harrison ..... 473/228
3,829,102 A * 8/1974 Harrison ..... 473/228
D257,873 S * 1/1981 MacDougall ..... D21/745
5,193,810 A * 3/1993 Antonious ..... 473/327
D338,935 S * 8/1993 Antonious ..... D21/733
5,318,297 A * 6/1994 Davis et al. ..... 473/327
5,505,448 A * 4/1996 Park ..... 473/327
5,511,786 A * 4/1996 Antonious ..... 473/327
5,524,890 A * 6/1996 Kim et al. ..... 473/242
5,544,884 A * 8/1996 Hardman ..... 473/327
D398,681 S * 9/1998 Galy ..... D21/733
D411,600 S * 6/1999 Antonious ..... D21/733
5,954,595 A * 9/1999 Antonious ..... 473/327
5,989,134 A * 11/1999 Antonious ..... 473/327
6,530,847 B1 * 3/2003 Antonious ..... 473/327
D489,424 S * 5/2004 Lee ..... D21/733
6,773,359 B1 * 8/2004 Lee ..... 473/327
2002/0006833 A1 * 1/2002 Mason ..... 473/300
2003/0220154 A1 * 11/2003 Anelli ..... 473/327
2003/0228931 A1 * 12/2003 Antonious ..... 473/327
2005/0009622 A1 * 1/2005 Antonious ..... 473/327

* cited by examiner

*Primary Examiner*—Raleigh W. Chiu
(74) *Attorney, Agent, or Firm*—Nathan N. Kallman

(57) ABSTRACT

A golf club is fabricated with at least one vertical stability plate and/or at least one horizontal stability plate at a club head. The golf club is provided with a stability plate and an asymmetrical wing, or a combination of the same, which are installed at an upper side or left and right sides of the head of the golf club such as a driver, wood or iron, for example.

An aerodynamic force generated in a downward direction by the loft of the club face is compensated by asymmetric wings applying an aerodynamic lifting force to an upper direction of the club head during a swing of the club. Even when a golfer has a swing speed or posture problem when swinging a club, the head of the club is guided to rotate along a desired proper orbit. A golf ball can be hit by a sweet spot of the head face of the club due to the stability and compensating force for achieving a straight drive, and enhanced flying distance.

7 Claims, 7 Drawing Sheets

GOLF CLUB

FIELD OF THE INVENTION

The present invention relates to a golf club and in particular to a driver and a fairway wood golf club wherein a club head is always swung along a proper orbit even when a swing posture is poor during a tee shot or when a golf swing is not accurately performed. In addition, a golf ball can be accurately hit by a sweet spot of a club head face, so that a golf ball can be driven a long distance in a desired direction.

DESCRIPTION OF THE PRIOR ART

Golf is played using golf clubs formed as drivers, fairway woods and irons of different lengths and types. When playing golf, a player moves along a set course and directs a golf ball into a corresponding cup. The number of strokes for sinking a golf ball into a hole was set previously with respect to each course. The player with the least number of strokes after playing the conventional eighteen holes wins the game.

It is necessary to use a proper grip and swing posture in order to drive a golf ball accurately into a fairway of a course, so that the golfer can putt and sink the golf ball into the hole or cup of the green with the least number of strokes. To drive a golf ball into the fairway, a club head needs to be swung along an accurate orbit, and the ball should be hit by a sweet spot of the club head face, while maintaining a square state in which a club head face is not opened or closed during a shot. In this case, since a golfer cannot play like a programmed machine, it is impossible to swing a golf club in a constant swing posture. Particularly, a golf ball is hit in a state so that a head face is opened or closed and that it is difficult to allow the golf ball to be driven in a desired direction.

For example, when a player strikes a golf ball with a strong force to make the golf ball fly a long distance, a large force may be applied to a player's shoulder, so that swing speed may decrease and the swing orbit may deviate thereby resulting in a poor drive.

As shown in FIG. 1, when a golfer hits a golf ball and the club head face is opened as shown in FIG. 1B, a slice impact occurs, so that a golf ball is driven to the right direction, and the golf ball may be driven out of the fairway and dropped in the rough. Thus, a loss of distance may occur and the following swings may be poor. In a worse case, the golf ball may be out of bounds, resulting in two penalty strokes. If the club head face is closed as shown in FIG. 1C, a hook impact occurs, so that the golf ball may be driven in a left direction. In this case, the golf ball may also be out of the fairway and may drop in the rough. In a worse case, the golf ball may be out of bounds. Therefore, it is needed to maintain a square state during a shot, and a golf ball should be hit by a sweet spot as shown in FIG. 1A, unless a golfer wants to try a draw shot or fade shot intentionally, so that a long flying distance may be obtained, and the following shot may be better.

The front surface of a golf club has a certain inclination loft different from other clubs based on a preferred flying distance of the golf ball. The golf club that is designed to hit the golf ball a long distance, such as a driver or a spoon (wood number 3) has a more flexible shaft as compared to other middle or short distance golf clubs. So, when a golfer swings a golf club, a downward force is generated based on an inclination angle. This downward force is increased as swing speed is increased. Therefore, as swing speed is increased, the downward force is increased, so that the ball is contacted irregularly with the upper part of the sweet spot of the club face to result in a higher vertical shot and loss of flight distance. As swing speed is decreased, downward force is decreased with respect to the normal force, so that the ball contacts irregularly with the lower part of the sweet spot of the club face to result in a ground shot and tremendous loss of flight distance.

Most professional or amateur golfers have the same dreams of hitting a golf ball while in a proper posture and driving a golf ball to fly a long distance. To realize these dreams, a description of a "Club Head of Golf Club" is found in Korean utility model registration and application no. 1994-19011. According to the afore-mentioned Korean application, a plurality of grooves of different depths are formed in the club head so that when a golf ball is hit, a certain hitting direction is maintained. In Korean utility model registration No. 299189, a "Golf Club Head Having Through Holes" is described, wherein through holes are formed at the lower side of a golf club to allow air to pass through the holes. With such construction, the club head has less resistance when a golfer swings. In addition, according to Korean patent registration No. 515213 in the name of the present applicant, a "Golf Club Having Air Guides", air guides are formed with certain widths being 10%-15% of the widths of the club head faces. Therefore it is possible to offset the downward force of the head based on aerodynamics, so that head speed can be significantly increased. However, this kind of patented club does not incorporate the novel features of the present invention wherein vertical and horizontal stability plates are provided which enable a stable swing. Also the patented golf club encounters a high rubbing resistance which causes a decrease in head speed, and which is accompanied by a strange air sound.

SUMMARY OF THE INVENTION

An object of this invention is to provide an improved golf club, which is capable of always maintaining a constant swing orbit by improving the structure of a golf club, namely a driver and a long distance fairway wood.

Another object of this invention is to provide an improved golf club that can more efficiently hit a golf ball by a sweet spot of a club head face.

To achieve these objects, there is provided an improved golf club in which at least one vertical stability plate and/or at least one horizontal stability plate are formed at a club head, with the vertical or horizontal stability plates being selectively fixed or detachable. The vertical stability plates are designed to maintain a square state in which a club head face is not opened or closed when a golf ball is hit, so that the golf ball is hit by a sweet spot of the club head face. The horizontal stability plates are designed to maintain a constant swing orbit during swinging at the golf ball as well as a consistent posture of the golfer from follow through to finish.

An asymmetrical wing formed to a horizontal stability plate generates a lift force and it compensates for the downward force, which is generated based on an inclination angle so that it satisfies the accuracy of impact in spite of changing of the swing speed.

With the disclosed construction, a golf club is always guided to swing along a proper orbit from an approach swing to a finish when a golfer swings, so that a club head face is not opened or closed, while maintaining a square state. In accordance with this invention, a golf ball is hit by a sweet spot of a club head face thereby causing a golf ball to fly a long distance in a straight direction. With the asymmetrical wing, flying distance may be significantly increased based on accurate hitting with a sweet spot of the club head face.

BRIEF DESCRIPTION OF THE DRAWINGS

The present invention will be described with reference to the drawings wherein.

DETAILED DESCRIPTION OF THE INVENTION

Figure 1:
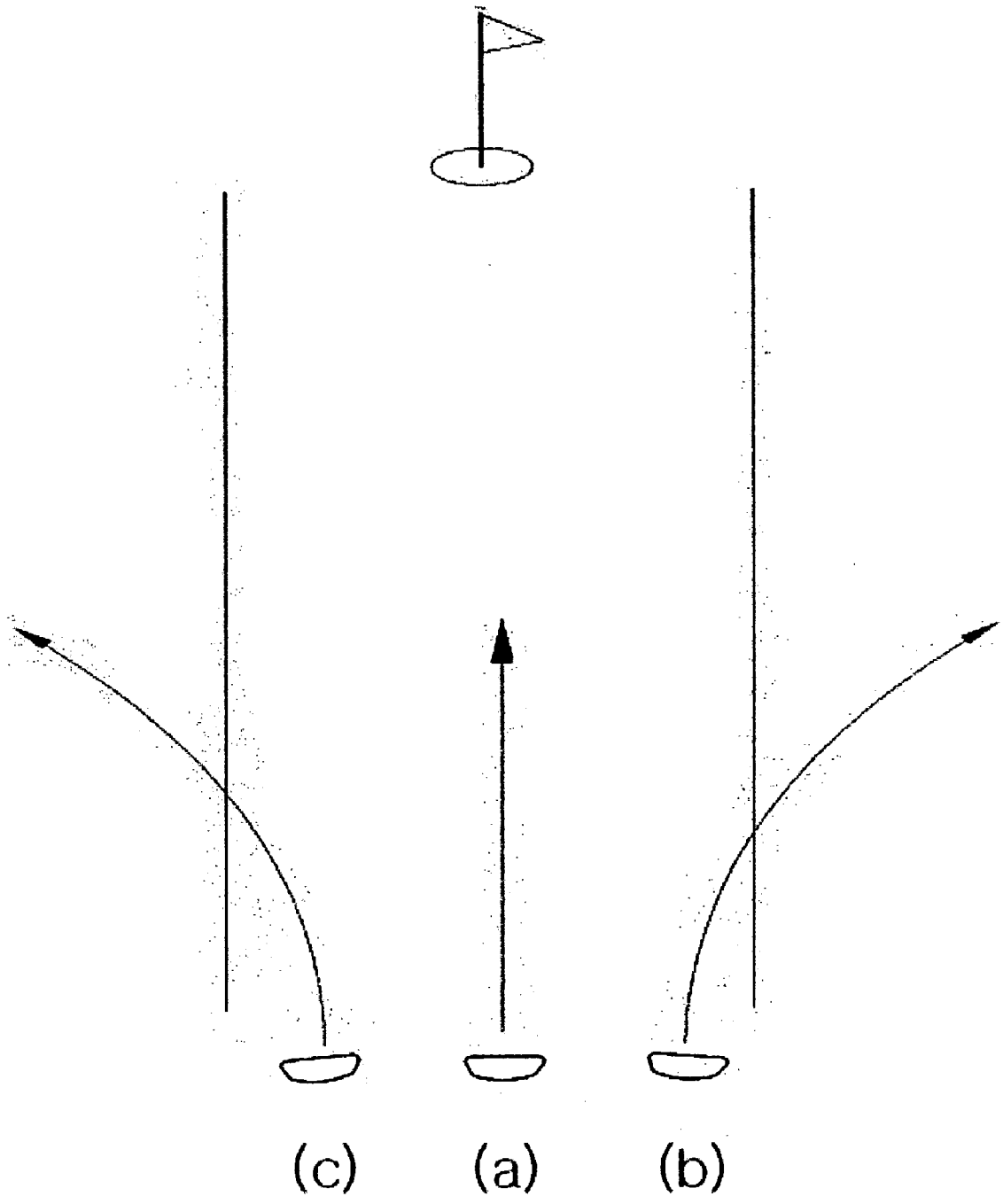
FIG. 1 is a plane view illustrating a flying direction of a golf ball after a golf ball is hit.
Figure 2:
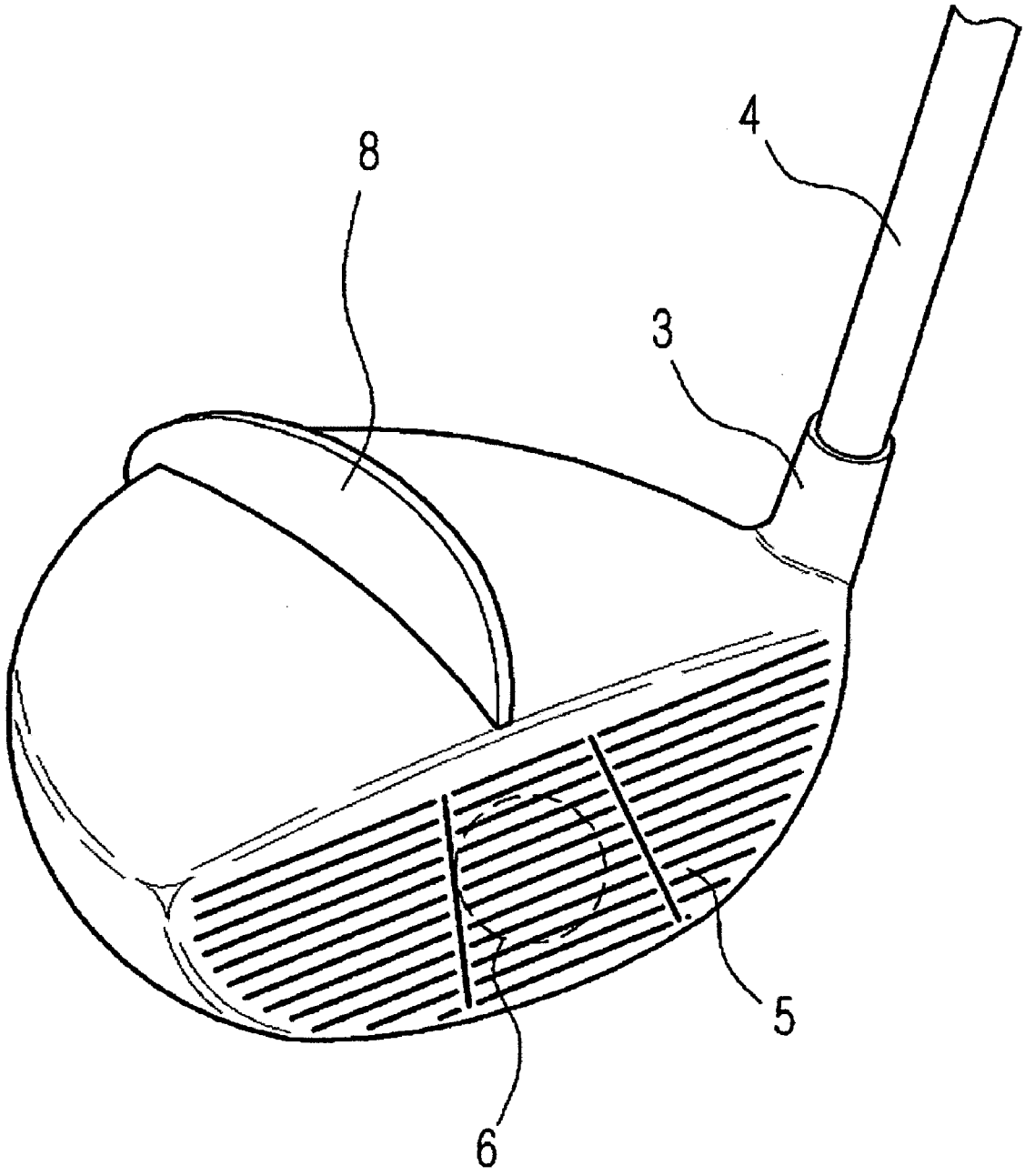
FIG. 2 is a perspective view illustrating a golf club in which a vertical stability plate is installed according to a first embodiment of the present invention.
Figure 3:
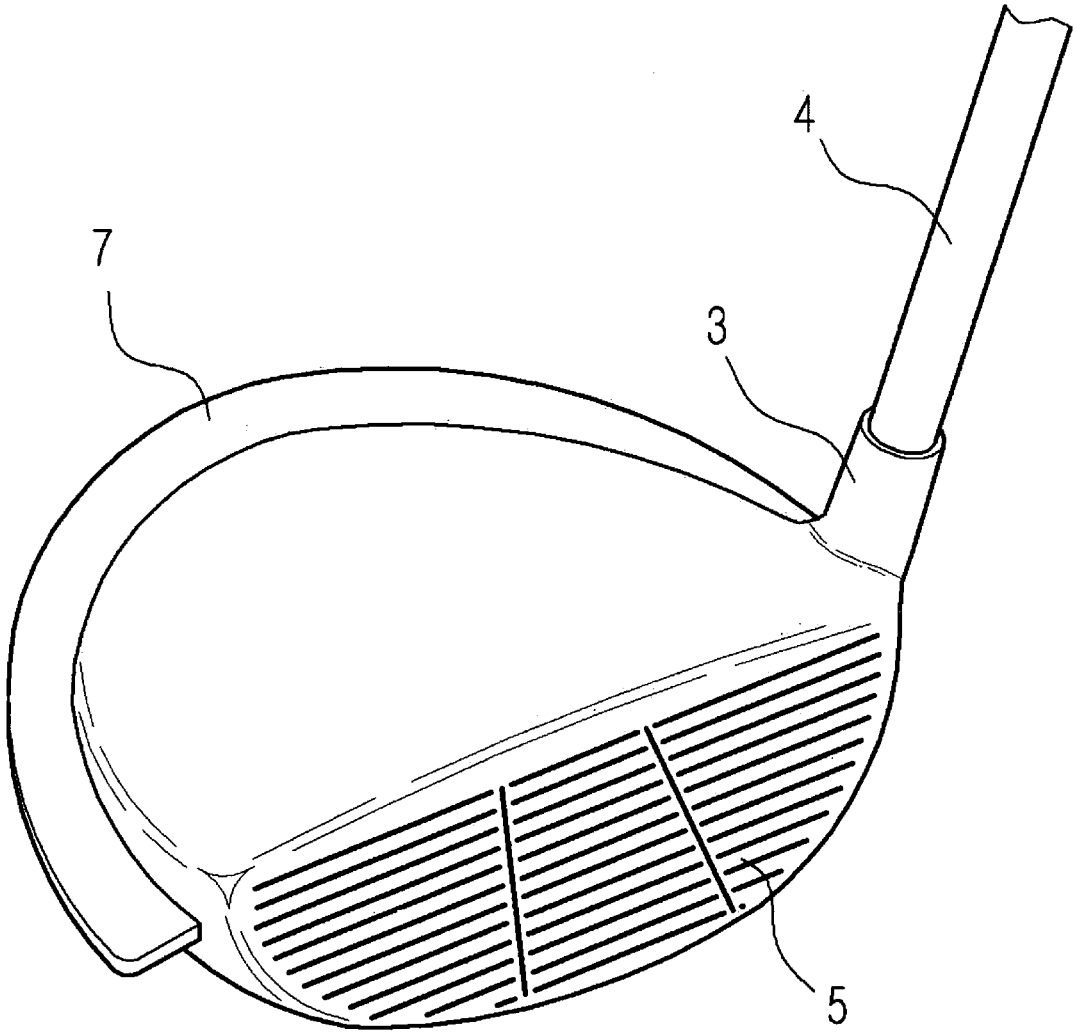
FIG. 3 is a perspective view illustrating a golf club in which a horizontal stability plate is installed at the head according to a second embodiment of the present invention.
Figure 4:
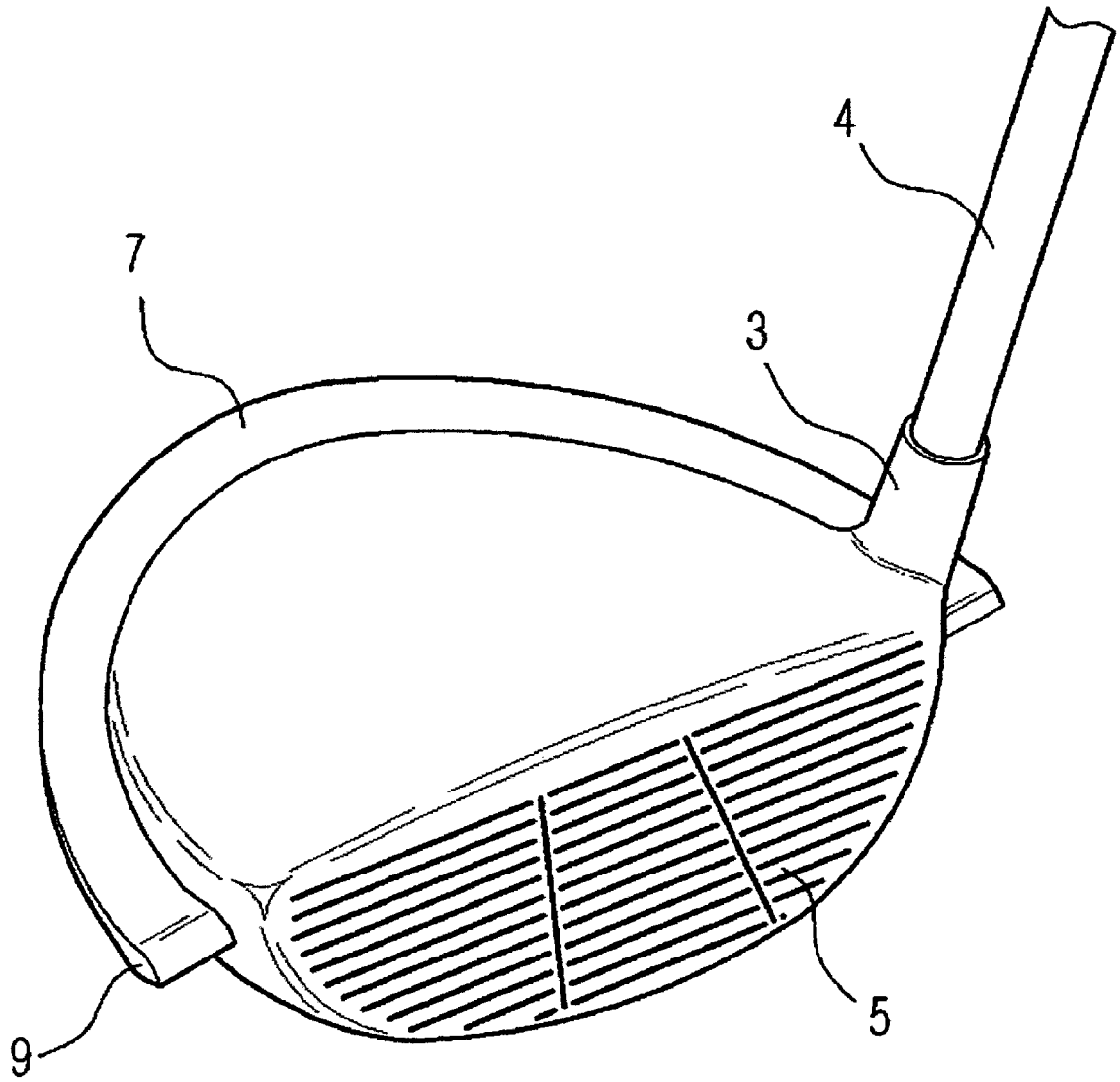
FIG. 4 is a perspective view illustrating a golf club in which an asymmetrical wing is attached to a horizontal stability plate according to a third embodiment of the present invention.

As shown in FIGS. 2-4, a preferred embodiment of the invention comprises at least one or more vertical stability plates 8 and/or at least one horizontal stability plate 7 are selectively fixed at a head 2 of a golf club 1 according to the present invention. The plates may be also assembled in a detachable way.

The vertical stability plate 8 has a function of allowing a club head face 5 to maintain a square state during a shot and a function of ensuring that the club head face 5 is not to be opened or closed despite a certain external unstable situation, such as non-uniform centrifugal force, or wrong address posture and grip, for example, so that a golf ball can be accurately hit by a sweet spot 6 of the club head face 5. Namely, the club head face 5 is not opened or closed during a shot based on the guidance of the vertical stability plates 8, while maintaining a squared state, so that an accurate shot can be obtained.

In addition, the horizontal stability plate 7 has a function of implementing a horizontal straight flight of a club head 2 by obtaining a stable swing orbit based on an enhanced horizontal stability during a shot, despite a certain external unstable situation, such as non-uniform aerodynamic vertical force based on swing speed, and wrong swing posture. It is possible to maintain a horizontal straight drive and furthermore, from a follow through to a finish after hitting a golf ball to increase the flying distance of a golf ball.

An asymmetrical wing 9 is formed with a streamline shape so when the club swings it generates a lift force that enhances swing accuracy.

FIGS. 2 and 3 show only one vertical stability plate 8 and only one horizontal stability plate 7. In another embodiment of the present invention, two vertical stability plates 8 or two horizontal stability plates 7 are provided. The vertical stability plate 8 and horizontal stability plate 7 may be plate shaped or a streamline shape for reducing air resistance and enhancing an outer look.

Also, the vertical stability plate 8 and the horizontal stability plate 7 may be fixed at the club head 2 or may be detachable from the same.

The vertical stability plate 8 and the horizontal stability plate 7 may be installed in various ways based on the preferred embodiment of the invention.

FIG. 3 is a perspective view illustrating a golf club 1, according to a second embodiment of the present invention, in which one horizontal stability plate 7 is provided. In addition, FIG. 4 is a perspective view of a golf club 1 according to a third embodiment of the present invention, in which a horizontal stability plate 7 and an asymmetrical wing 9 are installed.

A golfer who has a good swing orbit but has a slice or a hook during a tee shot does not need to install a horizontal stability plate 7. As shown in FIG. 2, it is preferred to install only the vertical stability plate 8. On the other hand, a golfer who does not slice or hook, but causes the golf ball to fly in a wrong direction by hitting with an upper part or lower part of the golf club 1, does not need to install the vertical stability plate 8. As shown in FIG. 3, it is preferred to install only the horizontal stability plate 7. To provide an upper compensating force and maintain a proper swing orbit, it is needed just to attach an arcuate asymmetrical wing 9 to the horizontal stability plate 7 as shown in FIG. 4.

Figure 5:
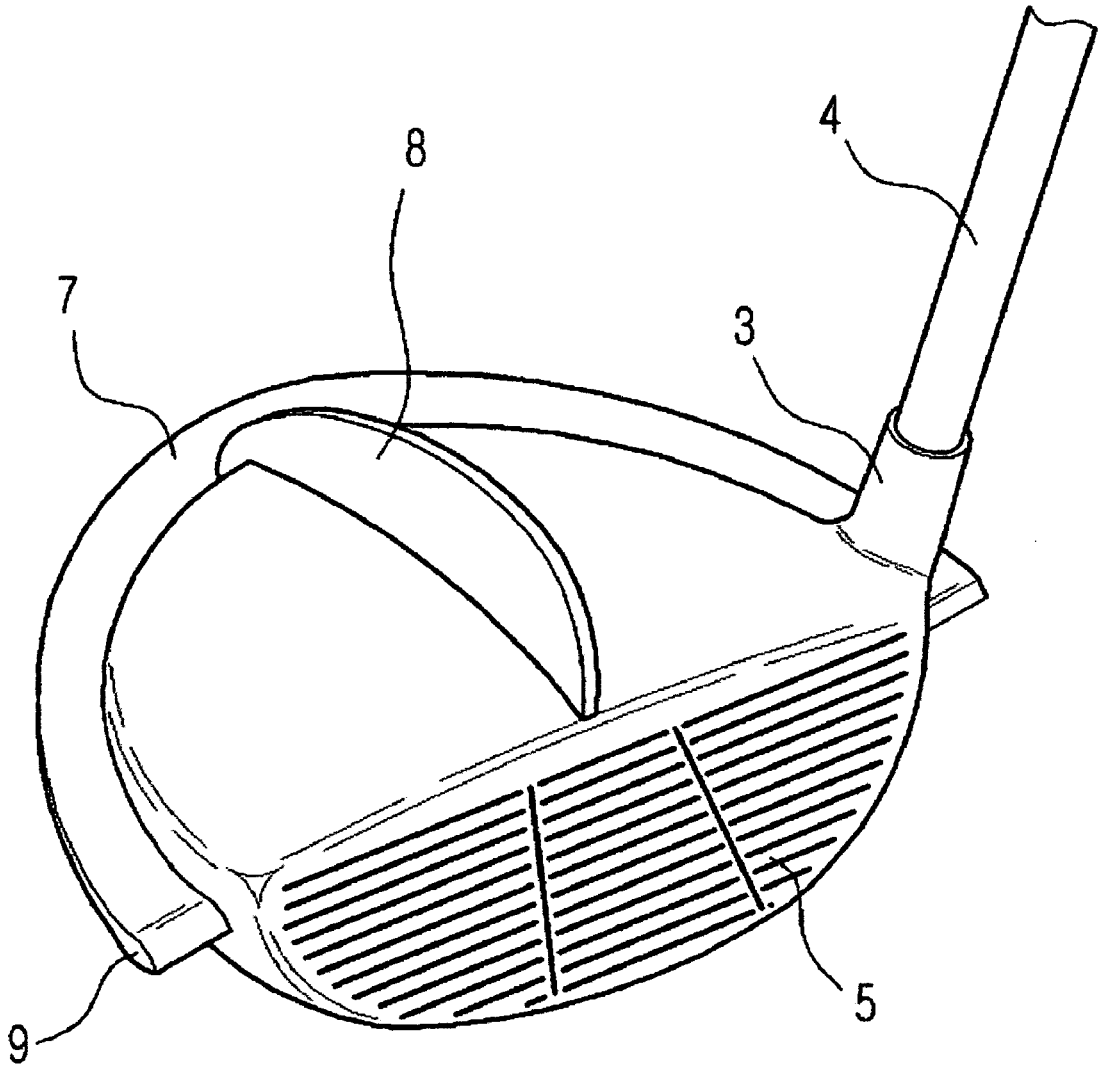
FIG. 5 is a perspective view illustrating a golf club in which a vertical stability plate and a horizontal stability plate are installed at the head according to a fourth embodiment of the present invention.

FIG. 5 is a perspective view of the fourth embodiment of the present invention in which a vertical stability plate 8 and a horizontal stability plate 7 with an asymmetrical wing 9 are attached together. With this construction, a stable swing orbit can be maintained, and a streamline shape asymmetrical wing 9 allows a lifting force to be generated for increasing flying distance based on an impact at a sweet spot. With this construction, a proper swing orbit and direction can be provided to both a beginner golfer who has a poor flying direction and swing orbit, and an experienced golfer. From now on, repeated practice may not be necessary, if it is only for managing to hit with the sweet spot at different levels of swing speed.

Figure 6:
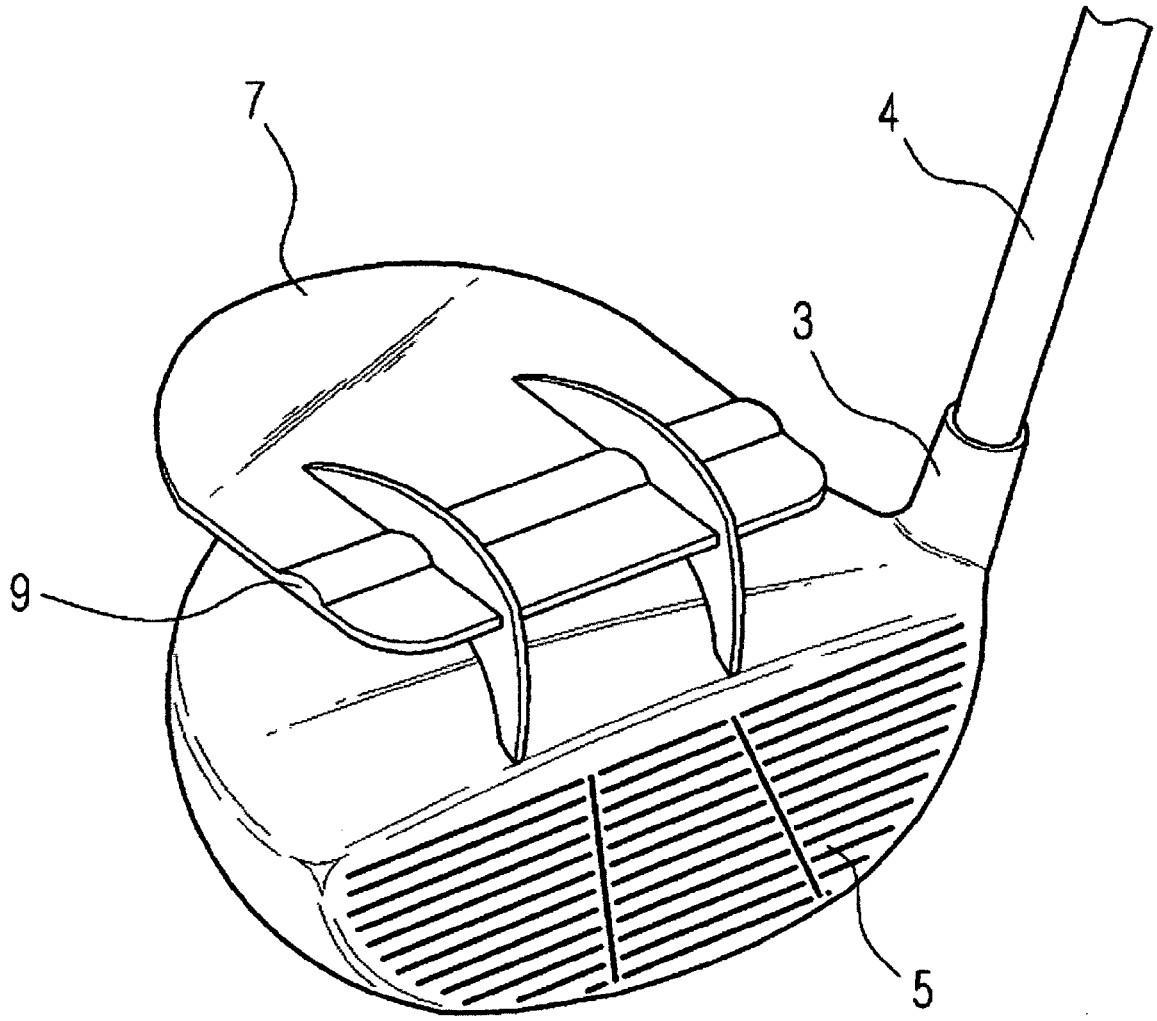
FIG. 6 is a perspective view illustrating a golf club in which a horizontal stability plate and an asymmetrical wing are installed at two vertical stability plates according to a fifth embodiment of the present invention.

FIG. 6 is a perspective view of the fifth embodiment of the present invention in which a horizontal stability plate 7 is not attached to a head body but attached to two vertical stability plates 8 increasing a lifting force of the wider asymmetrical wing 9.

Figure 7:
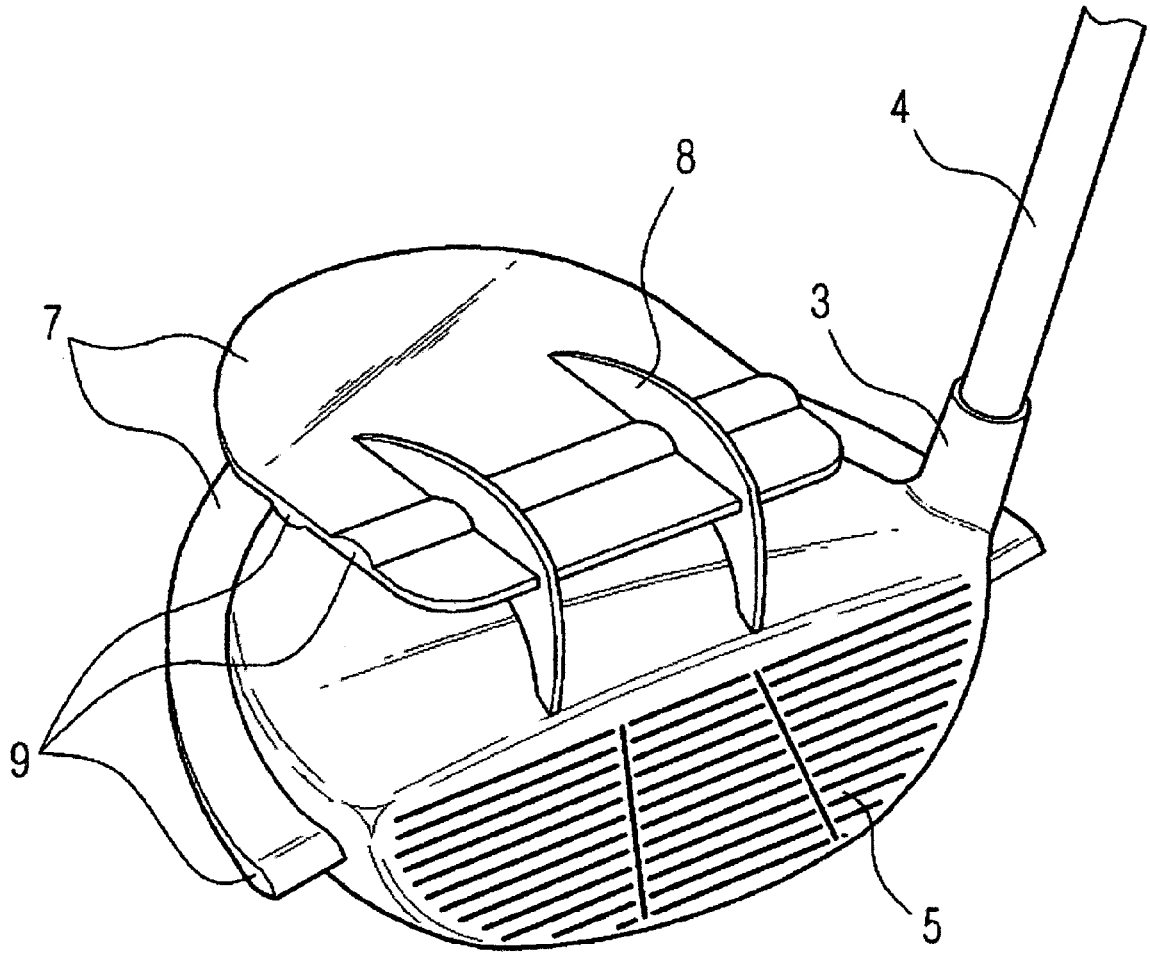
FIG. 7 is a perspective view illustrating a golf club in which another horizontal stability plate is attached to the head of the golf club depicted in FIG. 6, according to a sixth embodiment of the present invention.

FIG. 7 is a perspective view of the sixth embodiment of the invention. In this embodiment, a horizontal stability plate 7 and an asymmetrical wing 9 are attached to a club head in addition to the structure of FIG. 6. With this construction, it is possible to adjust a run of the golf ball after landing by providing a head with a draw shot as well as a fade shot can twisting moment as well as a lifting force, in such a manner that the position of the asymmetrical wings attached to the horizontal stability plates are changed. In addition the construction of FIG. 4 can be easily obtained by just removing the detachable vertical stability plate 8 and horizontal stability plate 7.

In addition, a draw shot as well as a fade shot can be implemented by changing the position of the asymmetrical wings 9 attached to the vertical stability plate 8 or by changing the length between the asymmetrical wings 9. Usually, in a golf course, there is a dogleg in which a fairway is curved at an intermediate distance in a left or right direction. A tall tree obstacle may be provided in the center of the fairway. In such case, it is needed to avoid the dogleg or the tall tree obstacle as well as maintaining one's flying distance. At this time, a draw shot or a fade shot is needed. One can easily achieve such a high skilled shot by just changing the number and position of the asymmetrical wings 9 attached to the surfaces of the vertical stability plate 8 and changing the length between the asymmetrical wings 9.

If we detach a normal vertical stability plate 8, and assemble a vertical stability plate 8 with two asymmetrical wings 9 for a fade shot, then the club head face is slightly opened during the impact for performing a fade shot. On the other hand, if we detach a normal vertical stability plate 8, and assemble a vertical stability plate 8 with two asymmetrical wings 9 for a draw shot, that are at the reverse position with respect to the case of a fade shot, then the club head face is closed during the impact for performing a draw shot.

In the above embodiments of the present invention, the vertical stability plate 8, the horizontal stability plate 7, and the asymmetrical wing 9 have certain widths and lengths. The widths and lengths of the same are determined to match well with the outer construction of the club head 2.

In addition, the vertical stability plate 8 and the horizontal stability plate 7 may be fixedly installed at the club head 2. For a detachable configuration, the vertical stability plate 8 and the horizontal stability plate 7 may be engaged at the fixing grooves formed at the club head 2 based on thread engagement or insertion, as by dovetail type for example.

The vertical stability plate 8 and the horizontal stability plate 7 may generate a certain resistance during a down swing following a back swing, but the resistance is not large. When a golfer starts a down swing, it is preferred not to take a fast swing from the start since the golfer posture may be changed. It is needed to maintain a posture in which the maximum acceleration can be obtained at the moment of impact during the down swing. In such case, a certain resistance of the vertical stability plate 8 or the horizontal stability plate 7 might be helpful to the rhythmical down swing.

It should be understood that the above-described examples are not limited by any of the details of the foregoing description, but should be construed broadly with its spirit and scope as defined in the appended claims.

What is claimed is:

1. A golf club comprising:

a club head having upper and lower surface areas;

at least one vertical stability plate fixed in position within grooves at said club head;

at least one horizontal stability plate fixed in position within grooves at said club head;

wherein said horizontal stability plate is installed normally relative to said vertical stability plate.

2. A golf club as in claim 1, wherein said at least one vertical stability plate comprises only two vertical stability plates of the same shape and size installed parallel to each other and positioned along a surface area of said club head.

3. A golf club as in claim 1, including an arcuate asymmetrical wing structure installed with said horizontal stability plate.

4. A golf club as in claim 3, wherein said wing structure is plate shaped or streamline shaped.

5. A golf club as in claim 3, wherein said wing structure comprises at least two separated wings installed with said horizontal stability plate.

6. A golf club comprising:

a club head having upper and lower surface areas;

a vertical stability plate fixed in position within a groove at said club head;

a horizontal stability plate fixed in position within a groove at said club head;

said horizontal stability plate being installed perpendicularly relative to said vertical stability plate; and an arcuate asymmetrical wing structure formed with said horizontal stability plate; said wing structure being streamline shaped.

7. A golf club as in claim 6, wherein said wing structure comprises at least two separated wings.

* * * * *